United States Patent [19]

Mitrovich et al.

[11] 4,371,276

[45] Feb. 1, 1983

[54] SHEET STACKING OUTPUT TRAY

[75] Inventors: Svetislav Mitrovich, Dallas; Ronald L. Beaty, Alvarado, both of Tex.

[73] Assignee: Xerox Corporation, Stamford, Conn.

[21] Appl. No.: 174,301

[22] Filed: Jul. 31, 1980

[51] Int. Cl.[3] ..... B65H 29/58

[52] U.S. Cl. ..... 400/625; 271/213; 400/629

[58] Field of Search ..... 400/625–629; 271/213

[56] References Cited

U.S. PATENT DOCUMENTS

| | | | |
|---|---|---|---|
| 3,430,748 | 3/1969 | Parri | 197/130 |
| 3,700,231 | 10/1972 | Aasen et al. | 271/64 |
| 3,963,110 | 9/1976 | Hyland et al. | 197/130 |
| 4,067,566 | 1/1978 | Williams | 271/2 |
| 4,189,135 | 2/1980 | Costa | 400/625 X |
| 4,220,323 | 9/1980 | Smith | 271/213 |
| 4,222,557 | 9/1980 | Wu | 400/625 X |
| 4,253,652 | 3/1981 | Steinhilber | 271/8 R |

FOREIGN PATENT DOCUMENTS

| | | | |
|---|---|---|---|
| 2803698 | 8/1978 | Fed. Rep. of Germany | 400/627 |

*Primary Examiner*—Richard J. Apley
*Assistant Examiner*—David J. Isabella

[57] ABSTRACT

For use in an automatic paper feeder supplying paper to an automatic typing system, apparatus is provided for selectively stacking the output sheet material from the automatic typing system in either their original input sequence order or in the reverse thereof. The apparatus includes an output tray and mounting means therefor adapted to support the output tray in either of two predetermined positions on the automatic paper feeder. Feed rollers eject the output sheet material vertically from the automatic paper feeder. Deflection means included on the output tray, together with the predetermined position of the output tray, determines the sequencing of the output sheet material.

5 Claims, 10 Drawing Figures

SHEET STACKING OUTPUT TRAY

The present invention relates in general to sheet handling apparatus and more particularly to apparatus that selectively stacks output documents or sheets in either their original input order or in reverse order.

The advent of programmable printing machines, such as automatic typewriters in word processing systems, has been very popular among businesses because of the speed and accuracy with which documents may be prepared. Many printing operations may be performed by the system without an operator in attendance if the system contains an automatic paper feeder. To eliminate the need for an operator in attendance while the printing operation is being performed, the automatic paper feeder should contain means for handling the finished document as it exits from the typewriter or printer.

U.S. Pat. Nos. 3,430,748 and 3,963,110 disclose automatic sheet feeders adapted to operate in conjunction with various electric typewriters. The automatic sheet feeders include an input tray for storing paper for further delivery of the paper into the typewriter or printer and an output tray for receiving paper that has been delivered from the typewriter or printer. In both cases, the top sheet in the input tray becomes the bottom sheet in the output tray. In other words, the order of the sheets in the output tray is the opposite of the order of the sheets when they werein the input tray.

U.S. Pat. No. 4,067,566 discloses a magazine for holding a stack of envelopes, together with apparatus for feeding the envelopes serially from the stack into a programmable printing machine and then, upon the exit of the envelopes from the printing machine, automatically feeding the envelopes back onto the top of the stack.

U.S. Pat. No. 3,700,231 discloses an attachment for placement on the top of a copying machine to control the stacking order of successive original documents fed through the machine. The attachment includes a baffle, which, when raised, does not intercept the original documents and allows the original documents to be stacked in a reverse order in a collecting tray as is the usual practice. However, when the baffle is lowered, it intercepts each original document and guides it so that it is flipped over. The original documents are collected in a different tray, and their order is the reverse of that usually obtained.

In the prior art apparatus used in conjunction with printers or typewriters for handling the inputting of the paper to the printers or typewriters and the subsequent handling of the finished product as it exits from the printer or typewriter, the finished product, when stacked in the output tray, will be in the reverse order of the sheets when they were stacked in the input tray. In other words, the bottom sheet in the output tray was previously the top sheet in the input tray while the sheet second from the bottom in the output tray was previously the next-to-the-top sheet in the input tray, etc. The reverse order of stacking of the finished product results in the need for the secretary to change the sequence or restack the sheets of the finished product so the first sheet of the document will be on the top of the stack, the second sheet of the document will be below the first sheet, etc. This reverse stacking in the output tray results in a waste of time and energy by the secretary to restack the sheets in their proper sequence prior to their further utilization in the normal course of office procedure.

The invention as claimed is intended to provide a solution primarily for the prior art deficiency of reverse stacking of the finished sheets upon their exit from the printer or typewriter.

The advantages offered by the invention are mainly that the operator, by positioning the output tray in one of two predetermined positions, may cause the finished sheets, upon their exit from the printer or typewriter, to be stacked in the same order of their stacked position when in the input tray. In the other position of the two predetermined positions, the finished sheets will be stacked in the output tray in the reverse order in which they were stacked in the input tray. The operator has the option of having the finished sheets stacked in the output tray in the smae order, from top to bottom, as the sheets were when in the input tray or of having the finished sheets stacked in the output tray in the reverse order of how they were stacked when they werein the input tray.

One means for carrying out the invention is described in detail below with reference to the drawing, which illustrates only one specific embodiment, in which.

Figure 8A:
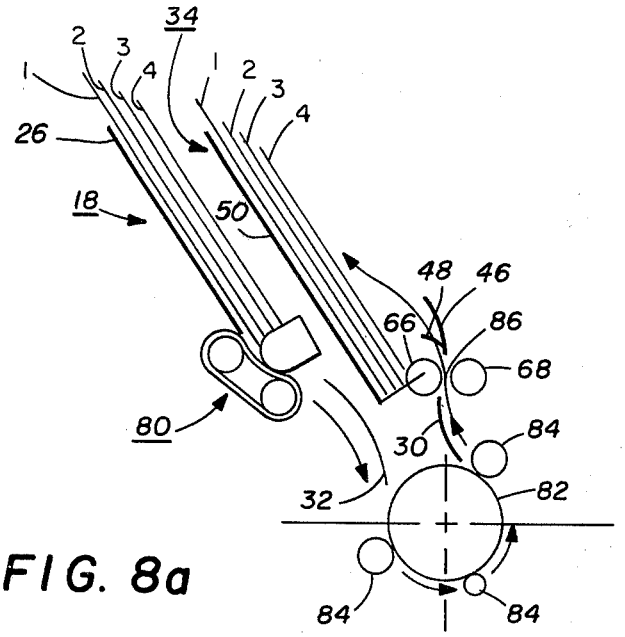
Figure 8B:
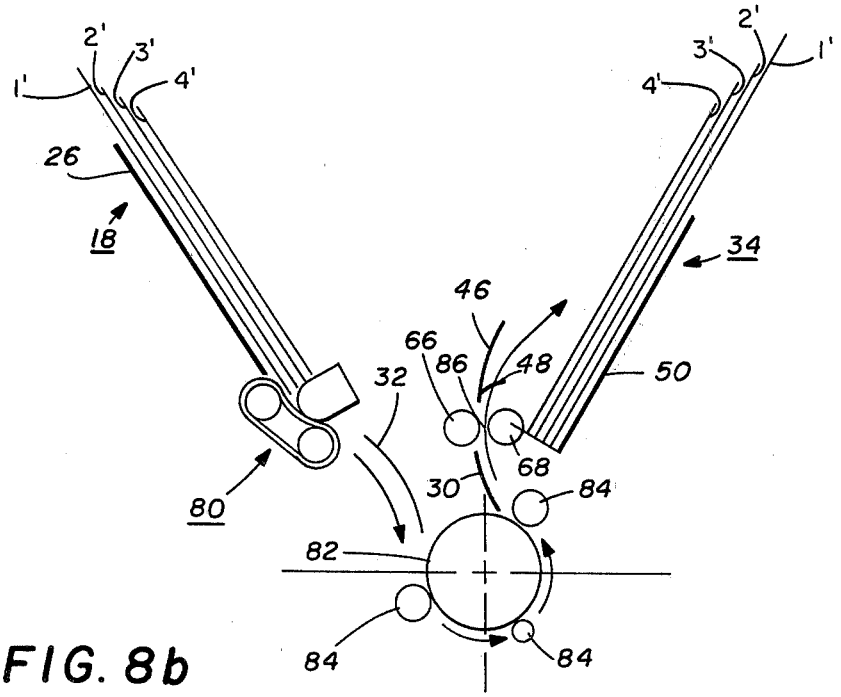

FIG. *7a* is a simplified side-sectional view showing the right-hand mounting means of the output tray and the automatic paper feeder when the output tray is positioned to provide reverse order stacking;

FIG. *7b* is a simplified side-sectional view showing the right-hand mounting means of the output tray and the automatic paper feeder when the output tray is positioned to provide original input order stacking; and FIGS. 8*a* and 8*b* depict the two possible sequences in which a series of sheets in the input tray can be stacked in the output tray with the use of our invention.

Figure 1:
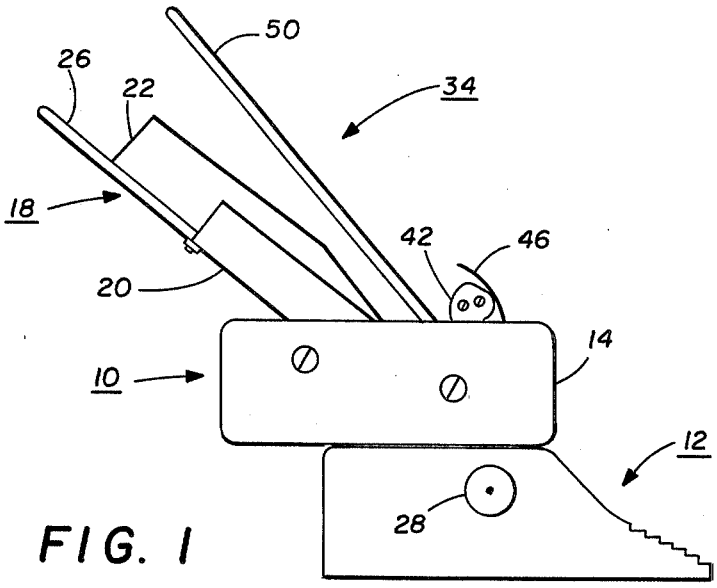
FIG. 1 is a simplified side view of an automatic paper feeder embodying the present invention with the present invention being positioned to provide reverse order stacking.
Figure 3:
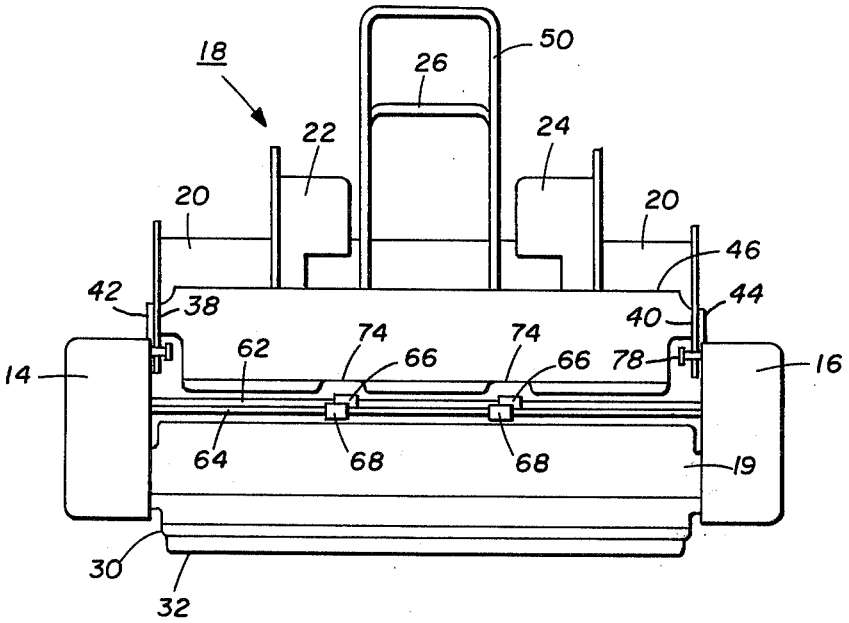
FIG. 3 is a simplified front view of an automatic paper feeder embodying the present invention with the present invention being positioned to provide reverse order stacking.

Referring now to FIG. 1, an automatic paper feeder 10 is shown in operative relationship with a printer or typewriter 12. With reference to FIGS. 1 and 3, the automatic paper feeder 10 comprises side housings 14 and 16 with input tray 18 and plate 19 connected therebetween. Input tray 18 comprises an outwardly fixed portion 20, inward movable portions 22 and 24 and a wire support bracket 26. Blank paper, forms, etc. (not shown) are inserted in the input tray 18 and are supported by the fixed portion 20, movable portions 22 and 24 and the support bracket 26. Movable portions 22 and 24 are adjusted to rest against the edges of the stack of paper (not shown) in the input tray 18. The automatic paper feeder 10 includes conventional means (not shown) to feed individual sheets from the input tray 18 to the platen area of the printer 12. Normally, electronics in the printer 12 advance the platen (not shown) to position the sheet (not shown) to the print position. The operator may also adjust the position of the sheet (not shown) by adjusting the platen (not shown) via the platen knob 28. The surface of baffle 32, which is positioned away from baffle 30, guides the paper (not shown) as it travels from the automatic paper feeder 10 to the printer 12. The surface of baffle 30, which is positioned away from baffle 32, guides the paper (not shown) as it exits the printer 12 on its way to the output tray 34.

Also with reference to FIGS. 1 and 3, output tray 34 is shown positioned in the location which results in the sheets being stacked in the output tray 34 in the reverse order of the sheets when they were stacked in the input tray 18. With additional referene to FIGS. 5 and 6, output tray 34 comprises frame 36, end brackets 38 and 40 formed as a right angle continuation of frame 36, baffle plate 46 with spring fingers 48 attached thereto by conventional means, links 42 and 44 connected between end brackets 38 and 40 and baffle plate 46 and support bracket 50 attached by fasteners 52 (only one shown). Curved or fishhook shaped projections 54 and 56 (see FIG. *7a*) extending from end brackets 38 and 40, respectively, together with cutouts 58 and 60 (see FIG. *7a*) form part of the means for mounting the output tray 34 to the automatic paper feeder 10. The details of the mounting structure will be discussed in further detail below with reference to FIGS. *7a* and *b*.

With further reference to FIG. 3, shafts 62 and 64 extend between side housings 14 and 16 with shaft 62 being driven by conventional means. Drive rollers 66 and idler rollers 68 are fastened around shafts 62 and 64, respectively. As the paper (not shown) exits from the printer or typewriter 12 upon completion of the printing operation, the paperis directed by baffle 30 to a nip formed by rollers 66 and 68. Rollers 66 and 68 then feed the paper out of the printer or typewriter 12 and to the output tray 34.

Figure 2:
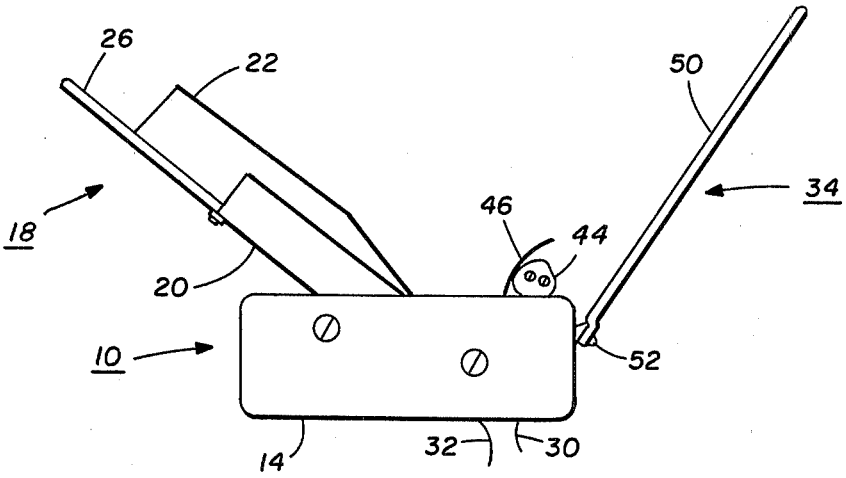
FIG. 2 is a simplified side view of an automatic paper feeder embodying the present invention with the present invention being positioned to provide original input order stacking.
Figure 4:
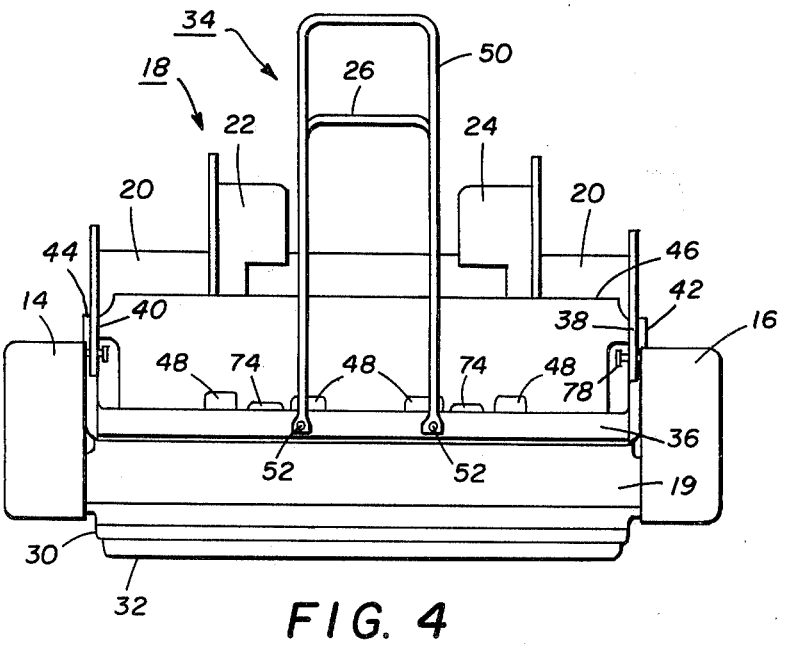
FIG. 4 is a simplified front view of an automatic paper feeder embodying the present invention with the present invention being positioned to provide original input stacking.

With reference to FIGS. 2 and 4, the output tray 34 is shown positioned in the location that results in the sheets being stacked in the output tray 34 in the same order in which the sheets were stacked in the input tray 18. It can be seen that support bracket 50 is formed by a rod shaped in a loop-type configuration and attached to frame 36 by fasteners 52. Output tray 34 slopes or leans toward the operator whereas in FIGS. 1 and 3, output tray 34 slopes or leans away from the operator and is rotated 180 degrees about a vertical line through the automatic paper feeder 10 with respect to its orientation in FIGS. 2 and 4.

Figure 6:
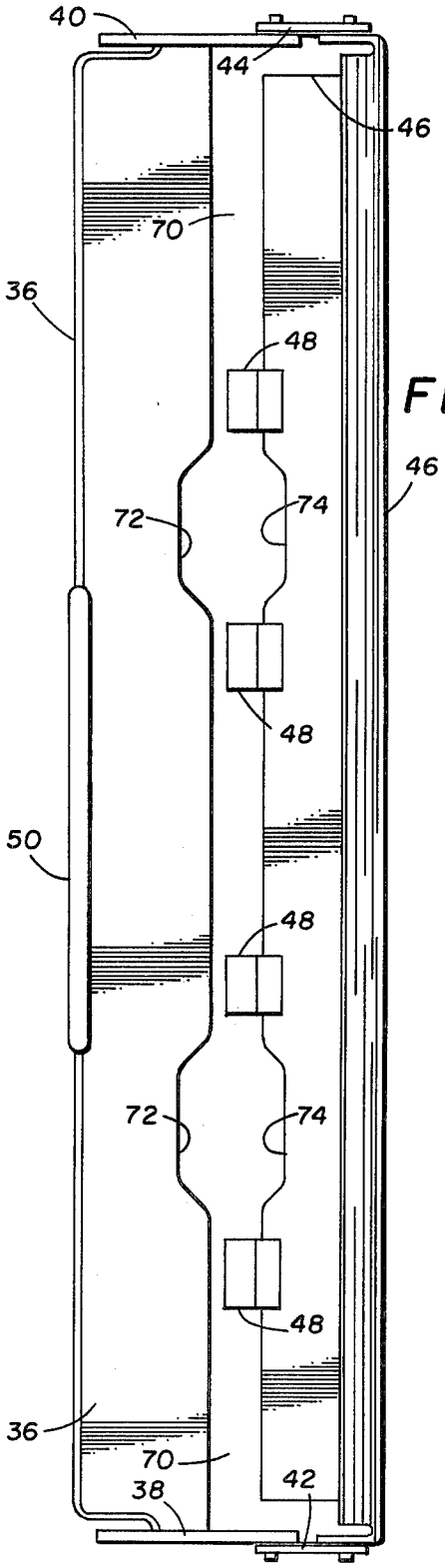
FIG. 6 is a simplified top view of the present invention.
Figure 7A:
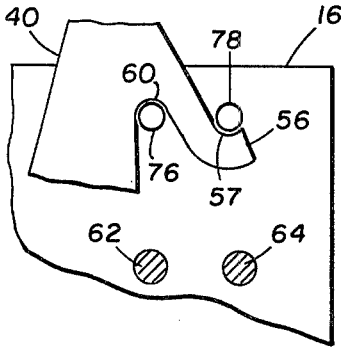
Figure 7B:
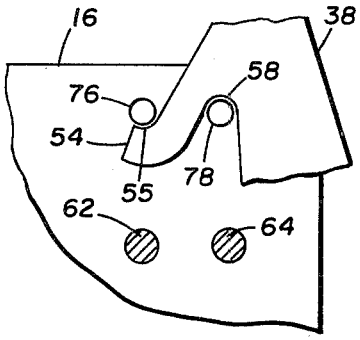
Figure 5:
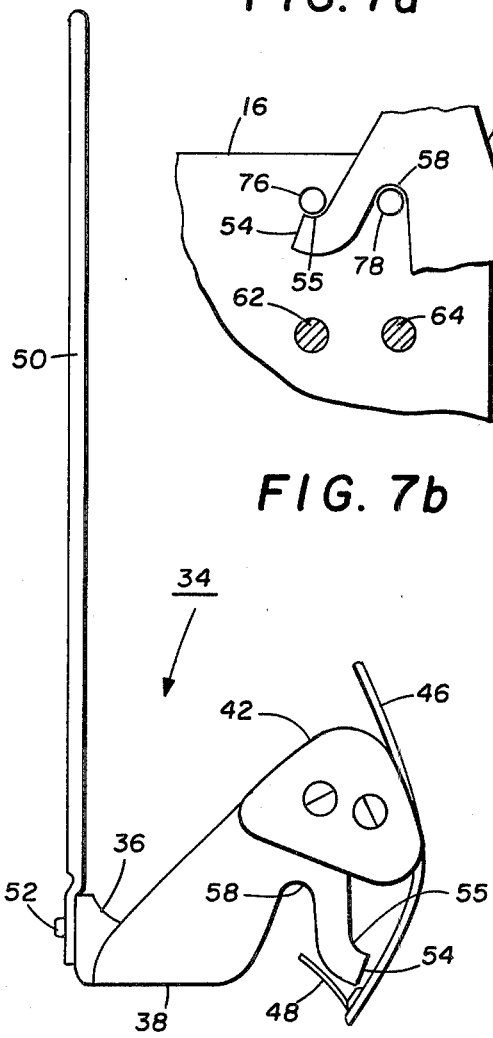
FIG. 5 is a simplified side view of the present invention.

With reference to FIG. 5, output tray 34 is shown removed from its mounting position on the automatic paper feeder 10. Output tray 34 is shown oriented basically, if it was rotated 45 degrees counterclockwise, as it is shown in FIG. 1 for reverse order stacking. Spring fingers 48, together with baffle plate 46, cause the sheets (not shown) to be directed toward support bracket 50 as the sheets exit from rollers 66 and 68 (SEE FIG. 3). As shown in FIG. 6, aperture 70 formed by frame 36 and baffle plate 46 are positionable around rods 62 and 64, together with rollers 66 and 68 (see FIG. 3). Cutouts 72 formed in frame 36, together with cutouts 74 formed in baffle plate 46, are positioned around rollers 66 and 68.

With reference to FIG. *7a*, one of the means for supporting or mounting the output tray 34 in operative relationship with the automatic paper feeder 10 is shown. The other means for supporting or mounting the output tray 34 is a mirror image of the one disclosed here and includes posts (not shown) in side housing 14 and end bracket 38 ofoutput tray 34. As shown in FIG. *7a*, the output tray is positioned as shown in FIGS. 1 and 3 to provide reverse order stacking of the paper exiting from printer or typewriter 12. Posts 76 and 78 protrude horizontally from side housing 16 toward center of paper feeder 10 and are positioned a predetermined distance apart on a horizontal plane with respect to the automatic paper feeder 10. To position or mount the output tray 34 onto the automatic paper feeder 10, the operator holds the output tray 34 such that the support bracket 50 is on the side of the output tray 34 away from the operator. The output tray 34isheld by the operator such as to position the curved projection 56 between posts 76 and 78 on side housing 16 while also positioning curved projection 54 between similar posts (not shown) on side housing 14. The output tray 34 is then rotated away from the operator until cutout 60 is positioned around post 76 in side housing 16, and cutout 58 is positioned around the corresponding post (not shown) in side housing 14. The upper edge 57 of curved portion 56 rests against the underneath side of post 78 while the upper edge 55 of curved portion 54 (see FIG. 5) rests against the corresponding portion of post (not shown) in side housing 14. The output tray 34 is in operative position to collect the paper (not shown) as it exits from the printer 12 as shown in FIG. 1.

With reference to FIG. *7b*, again one of the means for supporting or mounting the output tray 34 in operative relationship with the automatic paper feeder 10 is shown. The other means for supporting or mounting the output tray 34 is a mirror image of theone disclosed here and includes posts (not shown) in side housing 14 and end bracket 40 of output tray 34. As shown in FIG. *7b*, the output tray is positioned as shown in FIGS. 2 and 4 to provide original input order stacking of the paper (not shown) exiting from a printer or typewriter 12. To position or mount the output tray 34 onto the automatic paper feeder 10, the operator holds the output tray 34 such that the support bracket 50 is on the side of the output tray 34 toward the operator. The operator then positions the curved projection 54 between posts 76 and 78 on side housing 16 while also positioning curved projection 56 between similar posts (not shown) on side housing 14. The output tray 34 is then rotated toward the operator until cutout 58 is positioned around post 78 in side housing 16, and cutout 60 is positioned around the corresponding post (not shown) in side housing 14. The upper edge 55 of curved portion 54 rests against the underneath side of post 76 while the upper edge 57 of curved portion 56 rests against the corresponding post (not shown) in side housing 14. The output tray 34 is now in operative position to collect the paper (not shown) as it exits from the printer 12 as shown in FIG. 2.

FIG. *8a* depicts the positions of four documents numbered 1 through 4 in the input tray 18 and their subsequent positions in the output tray 34. The output tray 34 is positioned as previously shown in FIG. 1 to provide reverse order stacking. With respect to the sheets 1–4 as shown positioned in output tray 34, the lead line connecting each numeral to the respective sheet is extended to that sideof the sheet containing the printed matter or that side where the printed matter will be placed. In operation, sheet 1 in input tray 18 is fed by feed apparatus 80 to the platen 82 and platen feed rollers 84 where the desired characters and information is printed on the sheet 1. Sheet 1 is then fed or forwarded by platen 82 and platen feed rollers 84 to nip 86 formed by drive rollers 66 and idler rollers 68, which feed sheet 1 vertically upwardly therebetween. As sheet 1 exits from drive rollers 66 and idler rollers 68, sheet 1 is deflected by spring fingers 48 to rest in output tray 34 with the side of sheet 1 containing the printed matter facing toward the right or toward the operator (not shown). Sheets 2 through 4 follow the path of operation of sheet 1 with the results being reverse order stacking.

FIG. 8*b* depicts the positions of four documents numbered 1' through 4' in theinput tray 18 and their subsequent positions in the output tray 34. The output tray 34 is positioned, as previously shown in FIG. 2, to provide original input order stacking. With respect to sheets 1'–4' as shown positioned in output tray 34, the lead line connecting each numeral to the respective sheet is extended to that side of the sheet containing the printed matter or that side where the printed matter will be placed. The operation is the same as previously discussed with reference to FIG. 8*a*, except this time, when the operator removes sheets 1'–4' from the output tray 34, the sheets are in correct order and do not require restacking.

Although the present invention has been described with reference to a presently preferred embodiment, it will be appreciated by those skilled in the art that various modifications, alternatives, variations, etc. may be made without departing from the spirit and scope of the invention as defined in the appended claims.

What is claimed is:

1. In a cut sheet feeding apparatus for use with an independently operable printing machine and having an input tray for storing a plurality of sheet members, sheet feeding means for feeding sheet members in singular sequence from said input tray to said printing machine, the improvement comprising:

feed rollers operatively positioned to receive sheet members in singular sequence from said printing machine and feed said sheet members upwardly in a vertical direction;

an output tray operatively positionable in either of a first or a second position to receive said sheet members from said feed rollers;

deflection means attached to said output tray to deflect the vertically moving sheet members toward said output tray after passing through said feed rollers; and mounting means to operatively position said output tray in either of a first or a second position, whereby the output tray, when in a first position, receives sheets in a stacked sequence in the same order that the sheets were in when in the input tray, and, when in the second position, receives sheets in a stacked sequence in the reverse order that the sheets were in when in the input tray.

2. Apparatus as recited in claim 1 wherein said output tray comprises:

a frame member;

end brackets attached to opposite ends of said frame member and oriented essentially parallel to one another and essentially perpendicular to said frame member;

a curved projection formed in each of said end brackets and projecting outwardly from said frame member; and a portion of each end member between said curved projection and said frame being formed to provide a cutout portion, said curved projection and said cutout portion forming that portion of the mounting means integral to the output tray.

3. Apparatus as recited in claim 2 wherein said mounting means further includes two pins on opposing sides of said automatic paper feeder and positioned a predetermined distance apart in a horizontal plane to coact with that portion of the mounting means on the output tray to position said output tray in either of a first or second position.

4. Apparatus as recited in claim 1 wherein said deflection means includes a predetermined number of spring fingers.

5. Apparatus as recited in claim 4 wherein said deflection means further includes a baffle.

* * * * *